US005219912A

United States Patent [19]

Takahashi et al.

[11] Patent Number: 5,219,912

[45] Date of Patent: Jun. 15, 1993

[54] EMULSIFIED ALKENYLSUCCINIC ACID SIZING AGENT

[75] Inventors: Yoshio Takahashi; Junji Okazaki; Hideto Umekawa, all of Kanagawa; Toshihiro Tahara, Saitama, all of Japan

[73] Assignee: Mitsubishi Oil Co., Ltd., Tokyo, Japan

[21] Appl. No.: 727,727

[22] Filed: Jul. 10, 1991

[30] Foreign Application Priority Data

Jul. 11, 1990 [JP] Japan ..... 2-185054

[51] Int. Cl.[5] ..... D21H 17/16; D21H 17/42; D21H 17/62; C08K 5/09

[52] U.S. Cl. ..... 524/321; 524/107; 524/112; 524/271; 524/272; 524/549; 162/158; 162/168.1

[58] Field of Search ..... 524/107, 109, 549, 112, 524/271, 272; 162/158, 168.1

[56] References Cited

U.S. PATENT DOCUMENTS 4,529,447 7/1985 Okada et al. ..... 162/158
4,533,434 8/1985 Yoshioka et al. ..... 162/168.3
4,673,439 6/1987 Takahashi et al. ..... 162/158

FOREIGN PATENT DOCUMENTS 0025102 2/1977 Japan ..... 162/158

*Primary Examiner*—Thurman K. Page
*Assistant Examiner*—Andrew E. C. Merriam
*Attorney, Agent, or Firm*—Sughrue, Mion, Zinn, Macpeak & Seas

[57] ABSTRACT

An emulsified alkenylsuccinic acid sizing agent having a solid content of not less than 25% by weight is disclosed, which comprises a composition having not less than 25 parts by weight of alkenylsuccinic acid derived from the reaction product of a branched internal olefin of 12–18 carbon atoms with maleic anhydride, and being dispersed in water with an anionic polymer type dispersant or with an anionic polymer type dispersant and an emulsifier.

13 Claims, No Drawings

EMULSIFIED ALKENYLSUCCINIC ACID SIZING AGENT

FIELD OF THE INVENTION

The present invention relates to a novel alkenylsuccinic acid type of emulsified sizing agent which is stable in storage in high concentration, and produces remarkable efficiency in paper sizing.

BACKGROUND OF THE INVENTION

Saponification type (or solution type) rosin sizing agents have long been used in combination with aluminium sulfate as an internal paper sizing agent in acidic paper making. Such kinds of sizing agents are known to be less effective at a low addition ratio, and the effect is known to decrease at a high temperature or in a neutral pH region or in a closed water system. Emulsion type rosin sizing agents were developed to cancel such disadvantage of the saponification type rosin sizing agents. However, they are still less effective at a low addition ratio in sizing, and are not satisfactory.

To offset the disadvantages of the rosin sizing agents, a product derived by alkali-saponification of alkenylsuccinic acid has recently come to be used as a sizing agent because of its sufficient effect at a low addition ratio (U.S. Pat. No. 4,514,544). However, these sizing agents still have a disadvantage that the sizing efficiency is low in high temperature paper making or at paper making at around a neutral pH region.

Further, an emulsion type of alkenylsuccinic acid sizing agent is known which is derived by emulsifying alkenylsuccinic anhydride containing an emulsifier in a cationized starch solution or water at a low concentration of about 0.5 to 3% and is useful as a neutral paper sizing agent (U.S. Pat. No. 3,321,069).

The mechanism of action of alkenylsuccinic anhydride in neutral paper making is based on direct reaction of an anhydride group with a hydroxyl group of pulp and the fixation thereof onto pulp fibers to produce a sizing effect. Accordingly, in conventional neutral paper making, alkenylsuccinic anhydride has necessarily been added in an anhydride form to a pulp slurry. The alkenylsuccinic anhydride is highly reactive to water. Therefore, if the alkenylsuccinic anhydride is preliminarily emulsified and dispersed in water, it reacts with water in a short time to lose the anhydride group, thereby losing its function as a neutral sizing agent, and furthermore causing coagulation, precipitation, or separation of the emulsion owing to the change of the emulsion state in a process of conversion of alkenylsuccinic anhydride to alkenylsuccinic acid. Thus, an alkenylsuccinic anhydride type emulsion sizing agent for neutral paper making is storable only for several hours in an aqueous dispersion state. Therefore, it cannot be supplied commercially as an emulsion concentrate, and has to be emulsified just before paper making by an emulsifying machine. Moreover, at an acidic region employing aluminium sulfate as a fixing agent, the sizing efficiency develops slowly and is low immediately after paper making.

As described above, the insufficiency of the sizing effect of conventional alkenylsuccinic anhydride emulsions immediately after acidic paper making is considered to be due to the facts that the emulsion sizing agent is fixed in an unchanged acid anhydride form, undergoing slow reaction of the alkenylsuccinic anhydride with pulp in an acidic region, and long time is required in reaction of the alkenylsuccinic anhydride with water to form alkenylsuccinic acid to produce a sizing effect upon reaction with aluminum sulfate. Accordingly, if alkenylsuccinic acid preliminarily formed from alkenylsuccinic anhydride can be emulsified, rapid reaction thereof with aluminium sulfate and sufficient sizing effect are expected to be achieved.

Alkenylsuccinic acids, which are highly hydrophilic, cannot readily be emulsified. Therefore it is extremely difficult with conventional techniques to prepare the emulsion of the alkenylsuccinic acid which is storable stably for a long time in a high concentration. As described above, when alkenylsuccinic anhydride is emulsified with a conventional technique, the anhydride reacts with water in the emulsion to form alkenylsuccinic acid, giving an alkenylsuccinic acid emulsion. In the process of conversion of alkenylsuccinic anhydride to alkenylsuccinic acid, however, the emulsion state changes, giving no stable emulsion of alkenylsuccinic acid. In other words, even though an emulsion of alkenylsuccinic anhydride can be prepared temporarily in a high concentration, the alkenylsuccinic anhydride reacts with water in the emulsion to change into alkenylsuccinic acid, causing simultaneously coagulation, precipitation or separation without keeping a stable emulsion state, so that a stable emulsion cannot be obtained which contains alkenylsuccinic acid in a high concentration.

The inventors of the present invention made a comprehensive study to utilize the superior properties of alkenylsuccinic acid as a sizing agent in an emulsion type to solve the aforementioned problems. As a result, the present inventors have found that a suitably selected emulsifier and/or an anionic polymer type dispersant containing a proper monomer component and/or a hydrocarbon resin containing no acid group makes an emulsion extremely stable in storage and to produce excellent sizing efficiency in paper making even at a low addition ratio, at high temperature, and in about a neutral pH region, which could not be achieved by conventional saponified alkenylsuccinic acid type sizing agents, and completed the present invention.

SUMMARY OF THE INVENTION

The present invention intends to provide a novel sizing agent comprising alkenylsuccinic acid, which is free from the disadvantages of saponified alkenylsuccinic acid type sizing agents and alkenylsuccinic anhydride type emulsion sizing agents, and produces excellent sizing efficiency in paper making at high temperature over a broad pH range at a low addition ratio even immediately after the paper making, and has high storage stability at a high concentration.

The present invention provides an emulsified alkenylsuccinic acid sizing agent having a solid content of not less than 25% by weight, comprising a composition having more than 25 parts by weight of alkenylsuccinic acid derived from reaction of a branched internal olefin of 12–18 carbons with maleic anhydride, and being dispersed in water by an emulsifier and/or an anionic polymer type dispersant.

DETAILED DESCRIPTION OF THE INVENTION

The sizing agent of the present invention having the aforementioned constitution may be prepared by any of known conventional emulsifying methods, among which inversion methods are applicable most simply. In one method, alkenylsuccinic acid and a hydrocarbon resins are melt-blended thoroughly, and thereto an emulsifier and/or a polymer type dispersant are added and mixed sufficiently. Then water is added dropwise with stirring to cause phase inversion, thereby giving readily a sizing agent of the present invention.

In another inversion method, the whole or a portion of an emulsifier and/or a polymer type dispersant is dissolved in water instead of preliminarily to a composition having more than 25 parts by weight of alkenylsuccinic acid and the emulsification is conducted by phase inversion.

Furthermore, by using a high-pressure emulsifying machine, a finely stable alkenylsuccinic acid emulsion can be provided. In this case, a composition having more than 50 parts by weight of alkenylsuccinic acid is melt-blended by heating, and thereto hot water and an emulsifier and/or a polymer type dispersant are added to conduct a preliminary emulsification using a homogenizer, then emulsification is conducted using a high-pressure emulsifying machine.

Still another emulsifying method is naturally practicable also in which a composition having more than 25 parts by weight of alkenylsuccinic acid is dissolved in a water-insoluble organic solvent such as benzene and toluene, thereto water and an emulsifying agent and/or a polymer type dispersant are added, the mixture is emulsified by means of a homogenizer, a high-pressure emulsifying machine, and the like, and thereafter the organic solvent is distilled off.

In the present invention, further stable sizing effect can be achieved by using a hydrocarbon type resin having no acid group. The mixing ratio is 75 to 5 parts by weight of hydrocarbon type resin and 25 to 95 parts by weight of alkenylsuccinic acid.

The alkenylsuccinic acid used in the present invention is prepared by reacting alkenylsuccinic anhydride with an equimolar amount of water.

The alkenylsuccinic anhydride is prepared in a known method by addition reaction of maleic anhydride to an olefin. The olefin is desirably a branched internal olefin having 12 to 18 carbons in view of the sizing effect. Although an alkenylsuccinic acid derived from a linear olefin is less effective in sizing, it may be blended partially with the alkenylsuccinic acid derived from a branched olefin within the range that the effect of the present invention is not impaired.

By using alkenylsuccinic anhydride in place of alkenylsuccinic acid, an aqueous emulsion containing alkenylsuccinic anhydride can be obtained in a similar emulsification method. In this emulsion, the alkenylsuccinic anhydride reacts with water in the emulsion to become alkenylsuccinic acid in one or two days. However, owing to coexistence of the hydrocarbon type resin of the present invention, the emulsion state does not change at all during the conversion of the alkenylsuccinic anhydride to the alkenylsuccinic acid, without causing coagulation, precipitation, nor separation, being different from the emulsion containing only the alkenylsuccinic anhydride. Thus the sizing agent of the present invention containing the alkenylsuccinic acid is obtained in a stable form.

Thus, in a case where an alkenylsuccinic anhydride alone is emulsified, the addition of a hydrocarbon type resin is essential. In a case where an alkenylsuccinic acid is emulsified, however, the addition of a hydrocarbon type resin is not necessarily required.

The hydrocarbon type resin employed in the present invention may have no acid group (e.g., carboxyl group), and is compatible with the alkenylsuccinic acid or the alkenylsuccinic anhydride. In view of improvement of emulsifiability of the alkenylsuccinic acid and improvement of emulsion stability, the preferable resin includes aromatic resins, aliphatic resins, and aromatic-aliphatic mixed petroleum resins which are produced by polymerizing a cracked petroleum fraction having a boiling point in the range of from 20° to 280° C. derived by thermal cracking of petroleum; aromatic methylene resins (e.g., benzyl groups are bridged with methylene groups) containing substantially no oxygen atom; and aromatic formaldehyde resins having aromatic rings bonded through methylene, ether, acetal, methylol or the like, prepared by reaction of an aromatic compound with formaldehyde in the presence of a catalyst.

Although the hydrocarbon type resin employed in the present invention, which contains no acidic group, gives little sizing effect by itself, it serves to improve remarkably the emulsifiability and the emulsion stability when used mixedly with the alkenylsuccinic acid. The mixing ratio of the alkenylsuccinic acid and the hydrocarbon type resin, which are the main constituents of the sizing agent of the present invention, is 25 to 95% by weight of the alkenylsuccinic acid and 75 to 5% by weight of the hydrocarbon type resin. If desired, other resinous material may be incorporated in the composition, such as rosin, and a modified rosin such as a reaction product of rosin with an $\alpha,\beta$-unsaturated polybasic acid, disproportionated rosin, polymerized rosin, hydrogenated rosin, a reaction product of rosin with formaldehyde, fatty acid, tall oil, wax, hydrocarbons and the like. In this case, the total proportion of the alkenylsuccinic acid and the hydrocarbon type resin is preferably not less than 50% by weight. If resinous substances other than the alkenylsuccinic acid and the hydrocarbon type resin are contained in an amount of 50% or more, the sizing efficiency falls undesirably.

Preferable emulsifiers useful in the present invention include one or a mixture of two or more of anionic or nonionic emulsifiers. Such preferable emulsifiers include anionic surfactants such as alkylbenzenesulfonic acid salts, polyoxyethylne alkyl ether sulfuric acid ester salts, polyoxyethylene alkylphenyl ether sulfuric acid ester salts, polyoxyethylene aralkylphenyl ether sulfuric acid ester salts, alkyl ether sulfuric acid ester salts, polyoxyethylene alkyl ether phosphoric acid esters and salts thereof, polyoxyethylene alkylphenyl ether phosphoric acid esters and salts thereof, polyoxyethylene aralkylphenyl ether phosphoric acid esters and salts thereof and the like; nonionic surfactants such as polyoxyethylene alkyl ether, polyoxyethylene alkylphenyl ether, polyoxyethylene aralkylphenyl ether, sorbitan fatty acid ester, polyoxyethylenesorbitan fatty acid ester and the like. Among them, preferable are polyoxyethylene nonylphenyl ether phosphoric acid ester or polyoxyethylene nonylphenyl ether sulfuric acid ester salt.

The preferable polymer type dispersants include anionic copolymers of a component (A) monomer for constituting a hydrophilic moiety and a component (B) monomer for constituting a hydrophobic moiety, or partial or complete saponified anionic matter thereof. The component (A) includes acrylic acid, methacrylic acid, maleic acid, maleic anhydride, itaconic acid, fumaric acid and the like. The component (B) includes styrene type monomers such as styrene, and $\alpha$-methylstyrene; acrylate esters and methacrylate esters such as methyl acrylate, methyl methacrylate, ethyl acrylate, ethyl methacrylate, butyl acrylate, butyl methacrylate, (meth)acrylamide and acrylonitrile and the like; and mixtures of two more thereof.

The copolymer (or polymer) of the polymer type dispersant contains the component (A) in a ratio of from 5 to 100% by weight, preferably from 20 to 95% by weight, and the component (B) in a ratio of 95 to 0% by weight, preferably from 80 to 5% by weight, based on the total monomers. At the content of the component (A) of less than 5% by weight, dispersion effect is not achievable. The polymer type dispersant is synthesized by copolymerization according to a known emulsion polymerization or solution polymerization method. The partially or wholly saponified copolymer is derived by saponifying the resulting copolymer with an alkali such as sodium hydroxide and potassium hydroxide. The required saponification degree depends on the application field, and is not specially limited. The number average molecular weight of the anionic polymer type dispersant is not higher than 500,000, preferably in the range of from 10,000 to 300,000.

The amount of an emulsifier and/or a polymer type dispersant is 1 to 20 parts by weight, preferably 3 to 10 parts by weight with respect to a composition having more than 25 parts by weight of alkenylsuccinic acid.

In order to improve mechanical stability, an acrylamide type water-soluble polymer can be added to the resulting emulsion in an amount of 0 to 15 parts by weight, preferably 5 to 10 parts by weight, with respect to an alkenylsuccinic acid or an alkenylsuccinic acid and hydrocarbon type resin. The acrylamide type water-soluble polymer includes, e.g., a wholly or partially saponified copolymer of (meth)acrylamide and (meth)acrylic acid, a wholly or partially saponified copolymer of (meth)acrylamide and (meth)acrylic acid, or a wholly or partially saponified copolymer of (meth-)acrylamide and (meth)acrylic acid and styrene, each of the copolymers have a number average molecular weight of 100,000 to 600,000.

When a solid content concentration of the sizing agent is 1 to 70% by weight, a stable emulsion can be obtained. However, when it is less than 25% by weight, it is not practical in view of high transporting cost. The solid content concentration means components other than water in the sizing agent.

The sizing agent of the present invention may be added to paper material in any step before the completion of the paper making in the same manner as in conventional rosin type sizing agents. For example, the sizing agent of the present invention is fixed onto pulp by adjusting the pH of pulp slurry to be about 4.0–7.0 by addition of aluminium sulfate before or after addition of the sizing agent in or after a beating step. The sizing agent of the present invention may be used in combination with a conventional sizing agent such as a rosin type sizing agent, a petroleum resin sizing agent, and the like in an arbitrary ratio.

The amount to be used (amount of addition) of the sizing agent of the present invention, in internal sizing, is in the range of from 0.01 to 5.0% by weight, preferably from 0.05 to 3.0% by weight based on the dry pulp weight.

The present invention is described in more detail by reference to examples and comparative examples without limiting thereby the invention in any way. The term "parts" is based on weight unless otherwise mentioned.

STORAGE STABILITY TEST

Alkenylsuccinic acid type emulsion sizing agents prepared as described in Examples 1–20 and in Comparative examples 1, 3, 4 and 6, respectively, were taken in an amount of 25 g in a 50-ml glass bottle. The sizing agents were kept standing at room temperature (25° C.). The stability was observed visually after one day, 7 days, and 60 days. Less stable sizing agents caused deposition or separation of an oily matter at the bottom of the bottle or the top of the liquid. Incidentally, the sizing agents of Comparative Examples 2 and 5 are not tested for the storage stability because they are not of emulsion types but of saponified types.

The results are shown in Table 1.

SIZING EFFICIENCY TEST

Bleached kraft hardwood pulp was diluted with tap water to a pulp concentration of 2.5%, and was beaten by means of a beater to attain a Canadian freeness of about 450 ml. The resulting pulp slurry was diluted to a concentration of 2.0% by weight with tap water at a temperature of 50° C. With stirring, aluminum sulfate (in an amount of 1.0% by weight based on pulp) was added thereto. Subsequently, the slurry was diluted to a concentration of 0.5% by weight with water of pH 4.5 at 50° C., and one of the sizing agents of Examples 1–20 and Comparative Examples 1–6 was added thereto (in an amount of 0.3% by weight). Paper was made from the slurry by use of a TAPPI standard machine (the basis weight of the finished paper: 60 g/m$^2$). The resulting wet paper was pressed and dried in a conventional manner. The obtained finished paper was tested for sizing efficiency immediately after drying and after conditioning for one day in a conditioning room at a temperature of 20° C. and at a humidity of 65% RH by the Stöckigt method according to JIS P 8122.

For a high-pH paper making test, evaluation was also made by using aluminum sulfate in an amount of 0.7% by weight based on pulp, and dilution-water and papermaking-water of pH 6.0. In Examples 1–20 and Comparative Examples 4 and 6, the sizing agents were used 10 days after emulsification. In Comparative Example 3, the alkenylsuccinic anhydride emulsion sizing agent was used immediately after emulsification, since the emulsion was so poor in storage stability that the emulsion state could not be kept for 10 days after the emulsification.

MECHANICAL STABILITY TEST

Mechanical stability of the sizing agents of Examples 15 and 16 and Comparative Example 1 was conducted according to JIS K-6387. Specifically, in an apparatus (Maron testing machine) described in JIS K-6387, 50 g of the sizing agent which was diluted to 10% concentration was added and tested for 30 minutes with 10 kg loading, then the sludge occurrence was observed. The results are shown in Table 3. Example 15 provides less sludge as compared to Comparative Example 1. Example 16 in which acrylamide type soluble polymer was added provides no sludge.

SYNTHESIS OF POLYMER TYPE DISPERSANT

Synthesis Example 1

A mixture of 30 parts of styrene, 30 parts of n-butyl acrylate, 40 parts of acrylic acid, 5 parts of isopropyl alcohol, 4 parts of polyoxyethylene distyrylphenyl ether sulfuric acid ester ammonium (polymerization degree of oxyethylene: 13), 1 part of polyoxyethylene octylphenyl ether (polymerization degree of oxyethylene: 15), 2 parts of ammonium persulfate and 600 parts of water was prepared. The mixture was stirred at 80° C. for 3 hours to undergo polymerization. Subsequently, the mixture was cooled to 60° C., and thereto 20 parts of 38.9% potassium hydroxide was added dropwise gradually. The mixture was further stirred at 60° C. for 30 minutes, and cooled to room temperature. The resulting styrene-acrylic acid type copolymer had a solid content of 15% and a saponification degree of 25%. The number-average molecular weight of the copolymer before the saponification was about 170,000.

Synthesis Example 2

A mixture of 35 parts of styrene, 30 parts of n-butyl acrylate, 35 parts of acrylic acid, 5 parts of isopropyl alcohol, 4 parts of polyoxyethylene oleylphenyl ether sulfuric acid ester ammonium (polymerization degree of oxyethylene: 15), 1 part of polyoxyethylene dodecylphenyl ether (polymerization degree of oxyethylene: 12), 2 parts of ammonium persulfate and 600 parts of water was prepared. The mixture was stirred at 80° C. for 3 hours to undergo polymerization. Subsequently, the mixture was cooled to 60° C., and thereto 40 parts of 48.5% sodium hydroxide was added dropwise gradually. The mixture was further stirred at 60° C. for 30 minutes, and cooled to room temperature. The resulting styrene-acrylic acid type copolymer had a solid content of 15% and a saponification degree of 100%. The number-average molecular weight of the copolymer before the saponification was about 160,000.

Synthesis Example 3

40 Parts of maleic anhydride was dissolved in 100 parts of isopropyl alcohol, and heated under a nitrogen stream to a refluxing temperature. Thereto a mixture of 60 parts of n-butyl acrylate, 1 part of azobisisobutyronitrile and 100 parts of isopropyl alcohol was added dropwise in 2 hours. The mixture was kept at that temperature for 2 hours. Then a mixture of 29 parts of sodium hydroxide and 520 parts of water was added thereto dropwise. The isopropyl alcohol was distilled off by heating the mixture to the boiling temperature. Water was added thereto to obtain an aqueous pale brown transparent solution having a solid content of 20%, a saponification degree of 90%, and the molecular weight of the polymer of about 10,000.

Synthesis Example 4

A mixture of 10 parts of stearyl methacrylate, 30 parts of n-butyl acrylate, 60 parts of acrylic acid, 5 parts of isopropyl alcohol, 5 parts of polyoxyethylene distyrylphenyl ether sulfuric acid ester ammonium (polymerization degree of oxyethylene: 13) and 790 parts of water was prepared. The mixture was heated to 70° C. with stirring, upon which 10 ml of 10% ammonium persulfate was added thereto, and the mixture then further heated to 80° C. to undergo polymerization for 2 hours. Subsequently, the mixture was cooled to 60° C., and 167 parts of 20% sodium hydroxide was added dropwise gradually. The mixture was further stirred for 30 minutes, and cooled to room temperature. The resulting acrylic acid-methacrylic acid type copolymer had a solid content of 13% and a saponification degree of 100%. The number-average molecular weight of the copolymer before the saponification was about 100,000.

Synthesis Example 5

A mixture of 4 parts by weight of stearyl methacrylate, 7 parts of n-butyl acrylate, 89 parts of acrylic acid, 5 parts of 1% 2-mercaptoethanol and 5 parts of polyoxyethylene dibutylphenyl ether sulfuric acid ester ammonium (polymerization degree of oxyethylene: 13) was prepared. The mixture was polymerized in the same manner as in Synthesis Example 4, and saponified with 148 parts of 20% sodium hydroxide to obtain a copolymer having a solid content of 12% and a saponification degree of 60%. The number-average molecular weight of the copolymer before the saponification was about 50,000.

Synthesis Example 6

A mixture of 7 parts of n-butyl acrylate, 93 parts of acrylic acid, 10 parts of 1% 2-mercaptoethanol and 25 parts of 20% sodium dodecylbenzene sulfonate was prepared. The mixture was polymerized in the same manner as in Synthesis Example 4, and saponified with 103 parts of 20% sodium hydroxide to obtain a copolymer having a solid content of 12% and a saponification degree of 40%. The number-average molecular weight of the copolymer before the saponification was about 20,000.

Synthesis Example 7

A mixture of 4 parts of stearyl methacrylate, 7 parts of n-butyl acrylate, 75 parts of acrylic acid, 14 parts of acrylamide, 5 parts of 1% 2-mercaptoethanol and 5 parts of polyoxyethylene distyrylphenyl ether sulfuric acid ester ammonium (polymerization degree of oxyethylene: 13) was prepared. The mixture was polymerized in the same manner as in Synthesis Example 4, and saponified with 242 parts of 20% sodium hydroxide to obtain a copolymer having a solid content of 14% and a saponification degree of 100%. The number-average molecular weight of the copolymer before the saponification was about 50,000.

Synthesis Example 8

A mixture of 4 parts of stearyl methacrylate, 15 parts of n-butyl acrylate, 81 parts of acrylic acid, 5 parts of 2% 2-mercaptoethanol and 5 parts of polyoxyethylene distyrylphenyl ether sulfuric acid ester ammonium (polymerization degree of oxyethylene: 13) was prepared. The mixture was polymerized in the same manner as in Synthesis Example 4, and saponified with 226 parts of 20% sodium hydroxide to obtain a copolymer having a solid content of 13%, and saponification degree of 100%. The number-average molecular weight of the copolymer before the saponification was about 60,000.

EXAMPLE 1

30 parts of an aromatic methylene resin (trade name: Oligotech 1400, made by Mitsubishi Oil Co., Ltd., number average molecular weight: 900) was mixed with 70 parts of an alkenylsuccinic anhydride derived from addition reaction of maleic anhydride to a propylene oligomer (having 18 carbons in average). Added thereto were 4 parts of polyoxyethylene nonylphenyl ether phosphoric acid ester (polymerization degree of oxyethylene: 17) and 3 parts of polyoxyethylene nonylphenyl ether sulfuric acid ester ammonium (polymerization degree of oxyethylene: 4). Further thereto, water was gradually added to cause phase-inversion emulsification to prepare an oil-in-water type emulsion of a total solid content of 40% by weight.

EXAMPLE 2

30 parts of a commercial aromatic methylene resin (trade name: Oligotech 1300, made by Mitsubishi Oil Co., Ltd., number average molecular weight: 700) was mixed with 70 parts of an alkenylsuccinic anhydride derived from addition reaction of maleic anhydride to a propylene oligomer (having 15 carbons in average). Added thereto was 8 parts of polyoxyethylene nonylphenyl ether phosphoric acid ester (polymerization degree of oxyethylene: 17). Further, 10 parts of aqueous 20% solution of a saponified product of a commercial styrene-maleic acid copolymer (Trade name: HASMA1100, made by Misawa Ceramic Chemical Co., Ltd.) of a saponification degree of 60% was added thereto. Water was gradually added to cause phase-inversion emulsification to prepare an oil-in-water type emulsion of a total solid content of 45% by weight.

EXAMPLE 3

20 Parts of a commercial aromatic methylene resin (trade name: Oligotech 1300, made by Mitsubishi Oil Co., Ltd., number average molecular weight: 700) was mixed with 80 parts of an alkenylsuccinic anhydride derived from addition reaction of maleic anhydride to a propylene oligomer (having 15 carbons in average). Added thereto were 4 parts of polyoxyethylene nonylphenyl ether phosphoric acid ester (polymerization degree of oxyethylene: 17), 3 parts of polyoxyethylene nonylphenyl ether sulfuric acid ester ammonium (polymerization degree of oxyethylene: 4), and 2 parts of oleic acid. Further thereto, 13 parts of the polymer type dispersant prepared in Synthesis example 1 was added, and then water was gradually added to cause phase-inversion emulsification to prepare an oil-in-water type emulsion of a total solid content of 40% by weight.

EXAMPLE 4

10 parts of an alkenylsuccinic anhydride derived from addition reaction of maleic anhydride to a linear internal olefin (having 16 carbons in average) and 30 parts of an aromatic methylene resin (trade name: Oligotech 1400, made by Mitsubishi Oil Co., Ltd., number average molecular weight: 900) were mixed with 60 parts of an alkenylsuccinic anhydride derived from addition reaction of maleic anhydride to a propylene oligomer (having 15 carbons in average). Added thereto were 4 parts of polyoxyethylene nonylphenyl ether phosphoric acid ester (polymerization degree of oxyethylene: 17), 1 parts of polyoxyethylene distyryl phenyl ether phosphoric acid ester (polymerization degree of oxyethylene: 10), and 3 parts of polyoxyethylene nonylphenyl ether sulfuric acid ester ammonium (polymerization degree of oxyethylene: 4). Further thereto, water was gradually added to cause phase-inversion emulsification to prepare an oil-in-water type emulsion of a total solid content of 40% by weight.

EXAMPLE 5

25 Parts of a commercial aromatic methylene resin (trade name: Oligotech 1300, made by Mitsubishi Oil Co., Ltd., number average molecular weight: 700) and 5 parts of fumarated rosin (fumaration degree: 9%) were mixed with 70 parts of an alkenylsuccinic anhydride derived from addition reaction of maleic anhydride to a propylene oligomer (having 15 carbons in average). Added thereto were 4 parts of polyoxyethylene nonylphenyl ether phosphoric acid ester (polymerization degree of oxyethylene: 17), and 3 parts of polyoxyethylene nonylphenyl ether sulfuric acid ester ammonium (polymerization degree of oxyethylene: 4). Further thereto, water was gradually added to cause phase-inversion emulsification to prepare an oil-in-water type emulsion of a total solid content of 40% by weight.

EXAMPLE 6

30 parts of an aromatic formaldehyde resin (trade name: Oligotech X, a trial sample, made by Mitsubishi Oil Co., Ltd., number average molecular weight: 770) was mixed with 70 parts of an alkenylsuccinic anhydride derived from addition reaction of maleic anhydride to a propylene oligomer (having 15 carbons in average). Thereto, there were added 6 parts of polyoxyethylene nonylphenyl ether phosphoric acid ester (polymerization degree of oxyethylene: 17), and 12 parts of aqueous 25% sodium dodecylbenzenesulfonate solution. Further thereto, water was gradually added to cause phase-inversion emulsification to prepare an oil-in-water type emulsion of a total solid content of 40% by weight.

EXAMPLE 7

30 parts of an aromatic formaldehyde resin (trade name: Oligotech X, a trial sample, made by Mitsubishi Oil Co., Ltd., number average molecular weight: 770) was mixed with 70 parts of an alkenylsuccinic anhydride derived from addition reaction of maleic anhydride to a propylene oligomer (having 15 carbons in average). Added thereto were 5 parts of polyoxyethylene nonylphenyl ether phosphoric acid ester (polymerization degree of oxyethylene: 17), and 3 parts of polyoxyethylene nonylphenyl ether (polymerization degree of oxyethylene: 15). Further thereto, 8 parts of the polymer type dispersant of Synthesis example 3 was added, and then water was gradually added to cause phase-inversion emulsification to prepare an oil-in-water type emulsion of a total solid content of 35% by weight.

EXAMPLE 8

40 parts of a commercial aromatic methylene resin (trade name: Oligotech 1400, made by Mitsubishi Oil Co., Ltd., number average molecular weight: 900) was mixed with 60 parts of an alkenylsuccinic anhydride derived from addition reaction of maleic anhydride to a propylene oligomer (having 12 carbons in average). Added thereto were 4 parts of polyoxyethylene nonylphenyl ether phosphoric acid ester (polymerization degree of oxyethylene: 17), and 3 parts of polyoxyethylene nonylphenyl ether sulfuric acid ester ammonium (polymerization degree of oxyethylene: 4). Further thereto, water was gradually added to cause phase-inversion emulsification to prepare an oil-in-water type emulsion of a total solid content of 40% by weight.

EXAMPLE 9

20 parts of an aliphatic petroleum resin (trade name: Escorez 1304, made by Tonex Co., Ltd., average molecular weight: 1000) was mixed with 80 parts of an alkenylsuccinic anhydride derived from addition reaction of maleic anhydride to a propylene oligomer (having 15 carbons in average). Added thereto was 7 parts of polyoxyethylene nonylphenyl ether phosphoric acid ester (polymerization degree of oxyethylene: 17). Further thereto, water was gradually added to cause phase-inversion emulsification to prepare an oil-in-water type emulsion of a total solid content of 40% by weight.

EXAMPLE 10

60 parts of a commercial aromatic methylene resin (trade name: Oligotech 1300, made by Mitsubishi Oil Co., Ltd., number average molecular weight: 700) was mixed with 40 parts of an alkenylsuccinic anhydride derived from addition reaction of maleic anhydride to a propylene oligomer (having 15 carbons in average). Thereto 8 parts of polyoxyethylene nonylphenyl ether phosphoric acid ester (polymerization degree of oxyethylene: 17) was added, and the mixture was heated to 60° C. Further, 6 parts of aqueous 45% solution of a commercial anionic oligomer emulsifier (trade name: Polywet SN-4, made by Sumitomo Naugatuck Co., Ltd.) was added thereto. Then water was gradually added to cause phase-inversion emulsification to prepare an oil-in-water type emulsion of a total solid content of 40% by weight.

EXAMPLE 11

10 parts of a commercial aromatic methylene resin (trade name: Oligotech 1040, made by Mitsubishi Oil Co., Ltd., number average molecular weight: 300) was mixed with 90 parts of an alkenylsuccinic anhydride derived from addition reaction of maleic anhydride to a propylene oligomer (having 15 carbons in average). Thereto 40 parts of aqueous 25% sodium dodecylbenzenesulfonate solution was added. The resulting mixture is further mixed with 257 parts of warm water at 40° C. by means of a homomixer, and subsequently passed twice through a piston type high-pressure emulsifying machine (made by APV Gaulin Co.) at a pressure of 300 kg/cm$^2$ to prepare an oil-in-water emulsion having a total solid content of 30% by weight.

EXAMPLE 12

An alkenylsuccinic acid was prepared by reacting, with an equimolar amount of water, an alkenylsuccinic anhydride derived by addition reaction of maleic anhydride to propylene oligomer (having 15 carbons in average). 60 Parts of the resulting alkenylsuccinic acid was mixed with 40 parts of a commercial aromatic methylene resin (trade name: Oligotech 1100, made by Mitsubishi Oil Co., Ltd., number average molecular weight: 350). Further added thereto were 4 parts of polyoxyethylene nonylphenyl ether sulfuric acid ester ammonium, and 40 parts of polymer type dispersant of Synthesis Example 2. The resulting mixture was further mixed with 257 parts of hot water by means of a homomixer at 5000 rpm, and cooled to prepare an oil-in-water emulsion having a total solid content of 30% by weight.

EXAMPLE 13

10 parts of a commercial aromatic methylene resin (trade name: Oligotech 1100, made by Mitsubishi Oil Co., Ltd., number average molecular weight: 350) was mixed with 90 parts of an alkenylsuccinic anhydride derived from addition reaction of maleic anhydride to a propylene oligomer (having 15 carbons in average). Thereto 67 parts of the polymer type dispersant of Synthesis example 2 was added. The resulting mixture was further mixed with 315 parts of warm water at 90° C. by means of a homomixer, and subsequently passed twice through a piston type high-pressure emulsifying machine (made by APV Gaulin Co.) at a pressure of 500 kg/cm$^2$ to be homogenized, and quickly cooled to room temperature, thus an oil-in-water emulsion having a total solid content of 35% by weight being prepared.

EXAMPLE 14

An alkenylsuccinic acid was prepared by reacting, with an equimolar amount of water, an alkenylsuccinic anhydride derived by addition reaction of maleic anhydride to propylene oligomer (having 15 carbons in average). 100 parts of the resulting alkenylsuccinic acid was mixed with 21 parts of the dispersant of Synthesis Example 7. The resulting mixture was further mixed with 137 parts of hot water at 50° C. by means of a homomixer (10,000 rpm), and subsequently passed four times through a piston type high-pressure emulsifying machine (made by APV Gaulin Co.) at a pressure of 700 kg/cm$^2$ to be homogenized, and quickly cooled to room temperature, to prepare an oil-in-water emulsion having a total solid content of 40% by weight.

EXAMPLE 15

An alkenylsuccinic acid was prepared by reacting, with an equimolar water, an alkenylsuccinic anhydride derived by addition reaction of maleic anhydride to propylene oligomer (having 15 carbons in average). 80 parts of the resulting alkenylsuccinic acid was mixed with 20 parts of a commercial aromatic methylene resin (trade name: Oligotech 1100, made by Mitsubishi Oil Co., Ltd., number average molecular weight: 350). Thereto, 23 parts of the dispersant of Synthesis Example 4 was added. The resulting mixture was further mixed with 135 parts of hot water at 90° C. by means of a homomixer (10,000 rpm), and subsequently passed 4 times through a piston type high-pressure emulsifying machine (made by APV Gaulin Co.) at a pressure of 700 kg/cm$^2$ to be homogenized, and quickly cooled to room temperature to prepare an oil-in-water emulsion having a total solid content of 40% by weight.

EXAMPLE 16

20 parts of commercial anionic acrylamide polymer (solid content: 15%, trade name: Polyacron V, made by Misawa Ceramic Chemical Co., Ltd.) was mixed with the emulsion prepared in Example 15 to prepare an oil-in-water emulsion having a total solid content of 38% by weight.

EXAMPLE 17

An alkenylsuccinic acid was prepared by reacting, with an equimolar amount of water, an alkenylsuccinic anhydride derived by addition reaction of maleic anhydride to propylene oligomer (having 12 carbons in average). 100 parts of the resulting alkenylsuccinic acid was mixed with 33 parts of the dispersant of Synthesis Example 5. The resulting mixture was further mixed with 164 parts of hot water at 40° C. by means of a homogenizer (10,000 rpm), and subsequently passed four times through a piston type high-pressure emulsifying machine (made by APV Gaulin Co.) at a pressure of 700 kg/cm$^2$ to be homogenized, and quickly cooled to room temperature to prepare an oil-in water emulsion having a total solid content of 25% by weight.

EXAMPLE 18

An alkenylsuccinic acid was prepared by reacting, with an equimolar amount of water, an alkenylsuccinic anhydride derived by addition reaction of maleic anhydride to propylene oligomer (having 15 carbons in average). 100 parts of the resulting alkenylsuccinic acid was mixed with 23 parts of the dispersant of Synthesis Example 8. The resulting mixture was further mixed with 135 parts of hot water at 50° C. by means of a homomixer (10,000 rpm), and subsequently passed four times through a piston type high-pressure emulsifying machine (made by APV Gaulin Co.) at a pressure of 700 kg/cm$^2$ to be homogenized, and quickly cooled to room temperature to prepare an oil-in-water emulsion having a total solid content of 40% by weight.

EXAMPLE 19

An alkenylsuccinic acid was prepared by reacting, with an equimolar amount of water, an alkenylsuccinic anhydride derived by addition reaction of maleic anhydride to propylene oligomer (having 15 carbons in average). 80 parts of the resulting alkenylsuccinic acid was mixed with 20 parts of cylinder stock, and further 17 parts of the dispersant of Synthesis Example 6 was added thereto. The resulting mixture was further mixed with 174 parts of hot water at 90° C. by means of a homomixer (10,000 rpm), and subsequently passed four times through a piston type high-pressure emulsifying machine (made by APV Gaulin Co.) at a pressure of 700 kg/cm$^2$ to be homogenized, and quickly cooled to room temperature to prepare an oil-in-water emulsion having a total solid content of 35% by weight.

EXAMPLE 20

An alkenylsuccinic acid was prepared by reaction, with an equimolar amount of water, an alkenylsuccinic anhydride derived by addition reaction of maleic anhydride to n-butene oligomer (having 16 carbons in average). 100 parts of the resulting alkenylsuccinic acid was mixed with 21 parts of the dispersant of Synthesis Example 7. The resulting mixture was further mixed with 137 parts of hot water at 50° C. by means of a homomixer (10,000 rpm), and subsequently passed four times through a piston type high-pressure emulsifying machine (made by APV Gaulin Co.) at a pressure of 700 kg/cm$^2$ to be homogenized, and quickly cooled to room temperature to prepare an oil-in-water emulsion having a total solid content of 40% by weight.

COMPARATIVE EXAMPLE 1

A commercial emulsion type resin type sizing agent (solid content: 50%, trade name: OT-500J, made by Dick Hercules Co.) wherein a component essentially consisted of a fumarated resin was emulsified with a polymer type dispersant was used.

COMPARATIVE EXAMPLE 2

A commercial saponified rosin type sizing agent (solid content: 50%, trade name: RF Size 800L made by Misawa Ceramic Chemical Co., Ltd.) wherein a component essentially consisted of maleated rosin was saponified with potassium hydroxide was used.

COMPARATIVE EXAMPLE 3

10 parts of polyoxyethylene nonylphenyl ether sulfuric acid ester ammonium (polymerization degree of oxyethylene: 4) was added to 100 parts of alkenylsuccinic acid derived by addition reaction of maleic anhydride to propylene oligomer (having 15 carbons in average). The mixture was stirred sufficiently at 50° C. One part of the resulting mixture was further mixed with 99 parts of water and was emulsified by means of a homomixer at 10,000 rpm for 1 minute to obtain an oil-in-water emulsion having a total solid content of 1% by weight.

COMPARATIVE EXAMPLE 4

40 parts of a commercial aromatic methylene resin (trade name: Oligotech 1400, made by Mitsubishi Oil Co., Ltd., number average molecular weight: 900) was mixed with 60 parts of alkenylsuccinic anhydride derived from addition reaction of maleic anhydride with a linear internal olefin (having 16 carbons in average). Thereto further mixed were 8 parts of polyoxyethylene nonylphenyl ether phosphoric acid ester (polymerization degree of oxyethylene: 17), and 2 parts of polyoxyethylene distyrylphenyl ether phosphoric acid ester (polymerization degree of oxyethylene: 10). Thereto water was added gradually to cause phase-inversion emulsification to prepare an oil-in-water type emulsion of a total solid content of 40% by weight.

COMPARATIVE EXAMPLE 5

26 parts of an aqueous solution of potassium hydroxide in 126 parts of water were added to 60 parts of alkenylsuccinic anhydride derived by addition reaction of maleic anhydride with a propylene oligomer (having 12 carbons in average). The mixture was stirred within the temperature of from 90° to 100° C. for 3 hours, and cooled to room temperature to obtain a saponification type alkenylsuccinic anhydride sizing agent of a total solid content of 40% by weight.

COMPARATIVE EXAMPLE 6

60 parts of a fumarated rosin (fumaration degree: 9%) was mixed with 40 parts of an alkenylsuccinic anhydride derived from addition reaction of maleic anhydride to a propylene oligomer (having 15 carbons in average). Thereto polyoxyethylene nonylphenyl ether phosphoric acid ester (polymerization degree of oxyethylene: 17), and 3 parts of polyoxyethylene nonylphenyl ether sulfuric acid ester ammonium (polymerization degree of oxyethylene: 4) were added. Subsequently water was added gradually to cause phase-inversion emulsification to prepare an oil-in-water type emulsion of a total solid content of 40% by weight.

TABLE 1

Storage Stability Test
Amount of deposition after being left standing

| | Standing days | | |
|---|---|---|---|
| | 1 day | 7 days | 60 days |
| Example | | | |
| 1 | None | None | None |
| 2 | None | None | None |
| 3 | None | None | None |
| 4 | None | None | None |
| 5 | None | None | None |
| 6 | None | None | None |
| 7 | None | None | Trace amount |
| 8 | None | None | Trace amount |
| 9 | None | None | Trace amount |
| 10 | None | None | None |
| 11 | None | None | None |
| 12 | None | None | Trace amount |
| 13 | None | None | None |
| 14 | None | None | None |
| 15 | None | None | None |
| 16 | None | None | None |
| 17 | None | None | None |
| 18 | None | None | None |
| 19 | None | None | Trace amount |
| 20 | None | None | None |
| Comparative Example | | | |

TABLE 1-continued

| | Storage Stability Test Amount of deposition after being left standing | | |
|---|---|---|---|
| | Standing days | | |
| | 1 day | 7 days | 60 days |
| 1 | None | None | Trace amount |
| 2 | — | — | — |
| 3 | Large amount | Large amount | Large amount |
| 4 | None | None | Small amount |
| 5 | — | — | — |
| 6 | None | None | None |

TABLE 2

| | Sizing Effect Measurement Test Stöckigt sizing degree (seconds) | | | |
|---|---|---|---|---|
| | Aluminum Sulfate 1.0%, Water for dilution & paper-making: pH 4.5 | | Aluminum Sulfate 0.7%, Water for dilution & paper-making: pH 6.0 | |
| | Just after drying | After 1 day conditioning | Just after drying | After 1 day conditioning |
| Example | | | | |
| 1 | 21 | 24 | 14 | 15 |
| 2 | 22 | 25 | 14 | 16 |
| 3 | 20 | 23 | 13 | 14 |
| 4 | 18 | 20 | 11 | 13 |
| 5 | 20 | 21 | 13 | 15 |
| 6 | 19 | 21 | 13 | 15 |
| 7 | 18 | 20 | 12 | 14 |
| 8 | 18 | 19 | 11 | 12 |
| 9 | 19 | 22 | 12 | 13 |
| 10 | 17 | 18 | 11 | 12 |
| 11 | 17 | 20 | 11 | 13 |
| 12 | 17 | 19 | 11 | 12 |
| 13 | 20 | 22 | 14 | 15 |
| 14 | 17 | 18 | 13 | 13 |
| 15 | 22 | 23 | 17 | 17 |
| 16 | 24 | 24 | 17 | 18 |
| 17 | 18 | 18 | 13 | 14 |
| 18 | 17 | 19 | 12 | 14 |
| 19 | 18 | 18 | 12 | 12 |
| 20 | 17 | 17 | 13 | 14 |
| Comparative Example | | | | |
| 1 | 14 | 15 | 8 | 9 |
| 2 | 7 | 8 | 5 | 5 |
| 3 | 4 | 8 | 2 | 5 |
| 4 | 6 | 6 | 4 | 5 |
| 5 | 10 | 12 | 7 | 8 |
| 6 | 15 | 15 | 9 | 10 |

TABLE 3

| < Mechanical Stability Test > | |
|---|---|
| | Sludge Occurrence |
| Example 15 | Trace |
| Example 16 | None |
| Comp. Ex. 1 | Small |

The alkenylsuccinic acid type emulsion sizing agent of the present invention is superior in storage stability in high concentration and exhibits superior sizing effect immediately after paper making in comparison with conventional alkenylsuccinic anhydride emulsion sizing agent. Further, it does not become deteriorated in sizing effect in high temperature paper making over a broad pH range in comparison with saponified type alkenylsuccinic acid type sizing agent.

While the invention has been described in detail and with reference to specific embodiments thereof, it will be apparent to one skilled in the art that various changes and modifications can be made therein without departing from the spirit and scope thereof.

What is claimed is:

1. An emulsified alkenylsuccinic acid sizing agent having a solid content of not less than 25% by weight, comprising a composition having not less than 25 parts by weight of alkenylsuccinic acid derived from reaction product of a branched internal olefin of 12–18 carbon atoms with maleic anhydride, wherein the composition is, as the main components, comprised of 25 to 95 parts by weight of alkenylsuccinic acid and 75 to 5 parts by weight of hydrocarbon resin having no acid group, and being dispersed in water with an emulsifier, an anionic polymer dispersant, or an emulsifier and an anionic polymer dispersant, wherein the hydrocarbon resin is a resin selected from petroleum resins, aromatic methylene resins, aromatic formaldehyde resins, or a mixture of two or more thereof.

2. An emulsified alkenylsuccinic acid sizing agent having a solid content of not less than 25% by weight, comprising a composition having not less than 25 parts by weight of alkenylsuccinic acid derived from reaction product of a branched internal olefin of 12–18 carbon atoms with maleic anhydride, and being dispersed in water with an anionic polymer dispersant or with an anionic polymer dispersant and an emulsifier, wherein the anionic polymer dispersant is a polymer or a copolymer derived from (A) from 5 to 100% by weight of one or more of anionic unsaturated monomers selected from acrylic acid, methacrylic acid, maleic acid, maleic anhydride, itaconic acid, and fumaric acid, and (B) from 95 to 0% by weight of one or more of nonionic unsaturated monomers selected from styrenes, acrylic esters, methacrylic esters, acrylamide, methacrylamide, and acrylonitrile, or a partially or completely saponified product of a polymer or a copolymer derived from (A) and (B).

3. An emulsified alkenylsuccinic acid sizing agent having a solid content of not less than 25% by weight, comprising a composition having not less than 25 parts by weight of alkenylsuccinic acid derived from reaction product of a branched internal olefin of 12–18 carbon atoms with maleic anhydride, wherein the composition is, as the main components, comprised of 25 to 95 parts by weight of alkenylsuccinic acid and 75 to 5 parts by weight of hydrocarbon resin having no acid group, and being dispersed in water with an emulsifier, an anionic polymer dispersant, or an emulsifier and an anionic polymer dispersant, wherein the anionic polymer dispersant is a polymer or a copolymer derived from (A) from 5 to 100% by weight of one or more of anionic unsaturated monomers selected from acrylic acid, methacrylic acid, maleic acid, maleic anhydride, itaconic acid, and fumaric acid, and (B) from 95 to 0% by weight of one or more of nonionic unsaturated monomers selected from styrenes, acrylic esters, methacrylic esters, acrylamide, methacrylamide, and acrylonitrile, or a partially or completely saponified product of a polymer or a copolymer derived from (A) and (B).

4. An emulsified alkenylsuccinic acid sizing agent having a solid content of not less than 25% by weight, comprising a composition having not less than 25 parts by weight of alkenylsuccinic acid derived from reaction product of a branched internal olefin of 12–18 carbon atoms with maleic anhydride, wherein the composition is, as the main components, comprised of 50 to 95 parts by weight of alkenylsuccinic acid and 50 to 5 parts by weight of a component selected from a rosin, a rosin derivative, a tall oil, a fatty acid, a paraffin wax, a petroleum hydrocarbon, or a mixture of two or more thereof, and being dispersed in water with an anionic polymer dispersant, wherein the anionic polymer dispersant is a polymer or a copolymer derived from (A) from 5 to 100% by weight of one or more of anionic unsaturated monomers selected from acrylic acid, methacrylic acid, maleic acid, maleic anhydride, itaconic acid, and fumaric acid, and (B) from 95 to 0% by weight of one or more of nonionic unsaturated monomers selected from styrenes, acrylic esters, methacrylic esters, acrylamide, methacrylamide, and acrylonitrile, or a partially or completely saponified product of a polymer or a copolymer derived from (A) and (B).

5. An emulsified alkenylsuccinic acid sizing agent having a solid content of not less than 25% by weight, comprising a composition having not less than 25 parts by weight of alkenylsuccinic acid derived from reaction product of a branched internal olefin of 12–18 carbon atoms with maleic anhydride, wherein the composition is, as the main components, comprised of 25 to 95 parts by weight of alkenylsuccinic acid and 75 to 5 parts by weight of hydrocarbon resin having no acid group, and being dispersed in water with an emulsifier, an anionic polymer dispersant, or an emulsifier and an anionic polymer dispersant, wherein the hydrocarbon resin is a resin selected from petroleum resins, aromatic methylene resins, aromatic formaldehyde resins, or a mixture of two or more thereof, wherein the anionic polymer dispersant is a polymer or a copolymer derived from (A) from 5 to 100% by weight of one or more of anionic unsaturated monomers selected from acrylic acid, methacrylic acid, maleic acid, maleic anhydride, itaconic acid, and fumaric acid, and (B) from 95 to 0% by weight of one or more of nonionic unsaturated monomers selected from styrenes, acrylic esters, methacrylic esters, acrylamide, methacrylamide, and acrylonitrile, or a partially or completely saponified product of a polymer or a copolymer derived from (A) and (B).

6. An emulsified alkenylsuccinic acid sizing agent having a solid content of not less than 25% by weight, comprising a composition having not less than 25 parts by weight of alkenylsuccinic acid derived from reaction product of a branched internal olefin of 12–18 carbon atoms with maleic anhydride, and being dispersed in water with an anionic polymer dispersant or with an anionic polymer dispersant and an emulsifier, wherein 5 to 15 parts by weight of a wholly or partially saponified copolymer of (meth)acrylamide and (meth)acrylic acid, a wholly or partially saponified copolymer or (meth)acrylamide and (meth)acrylic acid and acrylonitrile or a wholly or partially saponified copolymer of (meth)acrylamide and (meth)acrylic acid and styrene, each of which as a number average molecular weight of 100,000 to 600,000, is added to a solid content of the resulting emulsion.

7. An emulsified alkenylsuccinic acid sizing agent having a solid content of not less than 25% by weight, comprising a composition having not less than 25 parts by weight of alkenylsuccinic acid derived from reaction product of a branched internal olefin of 12–18 carbon atoms with maleic anhydride, wherein the composition is, as the main components, comprised of 25 to 95 parts by weight of alkenylsuccinic acid and 75 to 5 parts by weight of hydrocarbon resin having no acid group, and being dispersed in water with an emulsifier, an anionic polymer dispersant, or an emulsifier and an anionic polymer dispersant, wherein 5 to 15 parts by weight of a wholly or partially saponified copolymer of (meth)acrylamide and (meth)acrylic acid, a wholly or partially saponified copolymer of (meth)acrylamide and (meth)acrylic acid and acrylonitrile or a wholly or partially saponified copolymer of (meth)acrylamide and (meth)acrylic acid and styrene, each of which has a number average molecular weight of 100,000 to 600,000, is added to a solid content of the resulting emulsion.

8. An emulsified alkenylsuccinic acid sizing agent having a solid content of not less than 25% by weight, comprising a composition having not less than 25 parts by weight of alkenylsuccinic acid derived from reaction product of a branched internal olefin of 12–18 carbon atoms with maleic anhydride, wherein the composition is, as the main components, comprised of 50 to 95 parts by weight of alkenylsuccinic acid and 50 to 5 parts by weight of a component selected from a rosin, a rosin derivative, a tall oil, a fatty acid, a paraffin wax, a petroleum hydrocarbon, or a mixture of two or more thereof, and being dispersed in water with an anionic polymer dispersant, wherein 5 to 15 parts by weight of a wholly or partially saponified copolymer of (meth)acrylamide and (meth)acrylic acid, a wholly or partially saponified copolymer of (meth)acrylamide and (meth)acrylic acid and acrylonitrile or a wholly or partially saponified copolymer of (meth)acrylamide and (meth)acrylic acid and styrene, each of which has a number average molecular weight of 100,000 to 600,000, is added with respect to solid content of the composition.

9. An emulsified alkenylsuccinic acid sizing agent having a solid content of less than 25% by weight, comprising a composition having not less than 25 parts by weight of alkenylsuccinic acid derived from reaction product of a branched internal olefin of 12–18 carbon atoms with maleic anhydride, wherein the composition is, as the main components, comprised of 25 to 95 parts by weight of alkenylsuccinic acid and 75 to 5 parts by weight of hydrocarbon resin having no acid group, and being dispersed in water with an emulsifier, an anionic polymer dispersant, or an emulsifier and an anionic polymer dispersant, wherein the hydrocarbon resin is a resin selected from petroleum resins, aromatic methylene resins, and aromatic formaldehyde resins, or a mixture of two or more thereof, wherein 5 to 15 parts by weight of a wholly or partially saponified copolymer of (meth)acrylamide and (meth)acrylic acid, a wholly or partially saponified copolymer of (meth)acrylamide and (meth)acrylic acid and acrylonitrile or a wholly or partially saponified copolymer of (meth)acrylamide and (meth)acrylic acid and styrene, each of which has a number average molecular weight of 100,000 to 600,000, is added with respect to solid content of the composition.

10. An emulsified alkenylsuccinic acid sizing agent having a solid content of not less than 25% by weight, comprising a composition having not less than 25 parts by weight of alkenylsuccinic acid derived from reaction product of a branched internal olefin of 12–18 carbon atoms with maleic anhydride, and being dispersed in water with an anionic polymer dispersant or with an anionic polymer dispersant and an emulsifier, wherein the anionic polymer dispersant is a polymer or a copolymer derived from (A) from 5 to 100% by weight of one or more of anionic unsaturated monomers selected from acrylic acid, methacrylic acid, maleic acid, maleic anhydride, itaconic acid, and fumaric acid, and (B) from 95 to 0% by weight of one or more of nonionic unsaturated monomers selected from styrenes, acrylic esters, methacrylic esters, acrylamide, methacrylamide, and acrylonitrile, or a partially or completely saponified product of a polymer or a copolymer derived from (A) and (B), wherein 5 to 15 parts by weight of a wholly or partially saponified copolymer of (meth)acrylamide and (meth)acrylic acid, a wholly or partially saponified copolymer of (meth)acrylamide and (meth)acrylic acid and acrylonitrile or a wholly or partially saponified copolymer or (meth)acrylamide and (meth)acrylic acid and styrene, each of which has a number average molecular weight of 100,000 to 600,000, is added with respect to solid content of the composition.

11. An emulsified alkenylsuccinic acid sizing agent having a solid content of not less than 25% by weight, comprising a composition having not less than 25 parts by weight of alkenylsuccinic acid derived from reaction product of a branched internal olefin of 12–18 carbon atoms with maleic anhydride, wherein the composition is, as the main components, comprised of 25 to 95 parts by weight of alkenylsuccinic acid and 75 to 5 parts by weight of hydrocarbon resin having no acid group, and being dispersed in water with an emulsifier, an anionic polymer dispersant, or an emulsifier and an anionic polymer dispersant, wherein the anionic polymer dispersant is a polymer or a copolymer derived from (A) from 5 to 100% by weight of one or more of anionic unsaturated monomers selected from acrylic acid, methacrylic acid, maleic acid, maleic anhydride, itaconic acid, and fumaric acid, and (B) from 95 to 0% by weight of one or more of nonionic unsaturated monomers selected from styrenes, acrylic esters, methacrylic esters, acrylamide, methacrylamide, and acrylonitrile, or a partially or completely saponified product of a polymer or a copolymer derived from (A) and (B), wherein 5 to 15 parts by weight of a wholly or partially saponified copolymer or (meth)acrylamide and (meth)acrylic acid, a wholly or partially saponified copolymer of (meth)acrylamide and (meth)acrylic acid and acrylonitrile or a wholly or partially saponified copolymer of (meth)acrylamide and (meth)acrylic acid and styrene, each of which has a number average molecular weight of 100,000 to 600,000, is added with respect to solid content of the composition.

12. An emulsified alkenylsuccinic acid sizing agent having a solid content of not less than 25% by weight, comprising a composition having not less than 25 parts by weight of alkenylsuccinic acid derived from reaction product of a branched internal olefin of 12–18 carbon atoms with maleic anhydride, wherein the composition is, as the main components, comprised of 50 to 95 parts by weight of alkenylsuccinic acid and 50 to 5 parts by weight of a component selected from a rosin, a rosin derivative, a tall oil, a fatty acid, a paraffin wax, a petroleum hydrocarbon, or a mixture of two or more thereof, and being dispersed in water with an anionic polymer dispersant, wherein the anionic polymer dispersant is a polymer or a copolymer derived from (A) from 5 to 100% by weight of one or more of anionic unsaturated monomers selected from acrylic acid, methacrylic acid, maleic acid, maleic anhydride, itaconic acid, and fumaric acid, and (B) from 95 to 0% by weight of one or more of nonionic unsaturated monomers selected from styrenes, acrylic esters, methacrylic esters, acrylamide, methacrylamide, and acrylonitrile, or a partially or completely saponified product of a polymer or a copolymer derived from (A) and (B), wherein 5 to 15 parts by weight of a wholly or partially saponified copolymer of (meth)acrylamide and (meth)acrylic acid, a wholly or partially saponified copolymer of (meth)acrylamide and (meth)acrylic acid and acrylonitrile or a wholly or partially saponified copolymer of (meth)acrylamide and (meth)acrylic acid and styrene, each of which has a number average molecular weight of 100,000 to 600,000, is added with respect to solid content of the composition.

13. An emulsified alkenylsuccinic acid sizing agent having a solid content of not less than 25% by weight, comprising a composition having not less than 25 parts by weight of alkenylsuccinic acid derived from reaction product of a branched internal olefin of 12–18 carbon atoms with maleic anhydride, wherein the composition is, as the main components, comprised of 25 to 95 parts by weight of alkenylsuccinic acid and 75 to 5 parts by weight of hydrocarbon resin having no acid group, and being dispersed in water with an emulsifier, an anionic polymer dispersant, or an emulsifier and an anionic polymer dispersant, wherein the hydrocarbon resin is a resin selected from petroleum resins, aromatic methylene resins, aromatic formaldehyde resins, or a mixture of two or more thereof, wherein the anionic polymer dispersant is a polymer or a copolymer derived from (A) from 5 to 100% by weight of one or more of anionic unsaturated monomers selected from acrylic acid, methacrylic acid, maleic acid, maleic anhydride, itaconic acid, and fumaric acid, and (B) from 95 to 0% by weight of one or more of nonionic unsaturated monomers selected from styrenes, acrylic esters, methacrylic esters, acrylamide, methacrylamide, and acrylonitrile, or a partially or completely saponified product of a polymer or a copolymer derived from (A) and (B), wherein 5 to 15 parts by weight of a wholly or partially saponified copolymer of (meth)acrylamide and (meth)acrylic acid, a wholly or partially saponified copolymer of (meth)acrylamide and (meth)acrylic acid and acrylonitrile or a wholly or partially saponified copolymer of (meth)acrylamide and (meth)acrylic acid and styrene, each of which has a number average molecular weight of 100,000 to 600,000, is added with respect to solid content of the composition.

* * * * *